US005485924A

United States Patent [19]

Zaun

[11] Patent Number: 5,485,924

[45] Date of Patent: Jan. 23, 1996

[54] CENTRIFUGAL SIFTER AND ELEMENTS THEREOF

[75] Inventor: Jochim M. Zaun, Ft. Thomas, Ky.

[73] Assignee: Sweco, Incorporated, Florence, Ky.

[21] Appl. No.: 239,649

[22] Filed: May 9, 1994

[51] Int. Cl.[6] ..... B07B 1/49

[52] U.S. Cl. ..... 209/300; 209/411; 209/413

[58] Field of Search ..... 209/284, 300, 209/399, 398, 402, 403, 404, 405, 406, 407, 409, 410, 411, 412, 413, 414

[56] References Cited

U.S. PATENT DOCUMENTS

| | | | |
|---|---|---|---|
| 2,193,006 | 3/1940 | Kufferath | 209/406 X |
| 3,655,045 | 4/1972 | McAllister, Jr. | 209/405 X |
| 4,202,759 | 5/1980 | Krolopp et al. | 209/300 X |
| 4,222,864 | 9/1980 | Keller | 209/284 |
| 4,627,345 | 12/1986 | Watts | 209/405 X |
| 4,929,346 | 5/1990 | Si-Lin | 209/405 X |

FOREIGN PATENT DOCUMENTS

| | | | |
|---|---|---|---|
| 3503043 | 7/1986 | Germany | 209/300 |

OTHER PUBLICATIONS

Publication of the Assignee entitled "Sweco Centrifugal Sifter—CS—2S Model".

*Primary Examiner*—William E. Terrell
*Assistant Examiner*—Tuan Nguyen
*Attorney, Agent, or Firm*—Lyon & Lyon

[57] ABSTRACT

A centrifugal sifter having a rotatable shaft with an auger and paddles located thereon. An inlet manifold presents material to be sifted to the auger. A cylindrical screen surrounds the paddles and is in turn confined within an outlet manifold where material sifted through the screen is collected and discharged. Material not passed through the screen exits the opposite end of the screen from the auger and is directed outwardly through an outlet manifold. The cylindrical screen includes circular beads at each end. These beads are positioned over short cylindrical elements and held between mounting plates and locking plates to retain the screen at each end. One of the screen clamps is slidably mounted in the centrifugal sifter and is held in place to tension the cylindrical screen by a resilient tensioning assembly. Rods extend to the slidably mounted screen clamp. Pneumatic expansion elements using air bags or pneumatic cylinders bias the rods to tension the cylindrical screen.

8 Claims, 4 Drawing Sheets

CENTRIFUGAL SIFTER AND ELEMENTS THEREOF

BACKGROUND OF THE INVENTION

The field of the present invention is centrifugal sifters.

Centrifugal sifters are well known which include an axially tensioned cylindrical screen mounted to a frame. A shaft including an auger along a first portion and paddles along a second portion is rotatably mounted within the frame with the paddles extending axially through the cylindrical screen. The shaft is driven by a motor. An inlet manifold delivers material to be separated to the auger. A first outlet manifold collects the sifted material from about the cylindrical screen. A second outlet manifold to one end of the cylindrical screen collects the material not sifted through the screen.

The cylindrical screen is mounted on short cylindrical flanges at either end. Clamp bands are typically positioned about the screen over the flanges and tightened. One of the mounting flanges is fixed to the frame while the other is mechanically drawn away from the first so as to tension the screens.

Difficulties can arise with the inappropriate mounting and tensioning of such cylindrical screens using clamp bands and a rigid tensioning mechanism. The paddles rotate rapidly within the cylindrical screen so as to generate pressure waves for enhancing sifting through the screen. Forces are in turn generated on the screen mounting mechanisms. Further, rigid tensioning of the screens can also result in a significant load on the mounting mechanisms. The screens also tend to axially elongate during use. A loss of tension in the cylindrical screen from such conditions can result which can in turn result in wear and failure of the screens.

SUMMARY OF THE INVENTION

The present invention is directed to centrifugal sifting employing mechanisms to mount and tension cylindrical screens.

In a first, separate aspect of the present invention, a screen clamp for cylindrical screens employs a circular bead fixed at an end of a cylindrical screen. A plate having a cylinder about a hole therethrough receives the end of the screen with the screen extending over the cylinder to abut against the plate. A locking plate also having a hole therethrough is arranged over the screen and over the cylinder and against the bead.

In a second, separate aspect of the present invention, screen clamps of the aforementioned design are incorporated on a centrifugal sifter with one such clamp being fixed to the sifter frame and the other such clamp being slidably mounted for tensioning the screen in an axial direction.

In a third, separate aspect of the present invention, a centrifugal sifter having clamps for retaining each end of a cylindrical screen are mounted to the frame of the sifter. One clamp is fixed to the frame while the other is slidably arranged. A resilient tensioning assembly is associated with the slidably mounted clamp to place a controlled yet resilient axial tension on the cylindrical screen. In one form, the resilient tensioning assembly may include a plurality of pneumatic expansion elements operating to bias the slidably mounted clamp away from the fixed clamp.

Accordingly, it is an object of the present invention to provide an improved centrifugal sifter and components therefor. Other and further objects and advantages will appear hereinafter.

DETAILED DESCRIPTION OF THE PREFERRED EMBODIMENT

Figure 1:
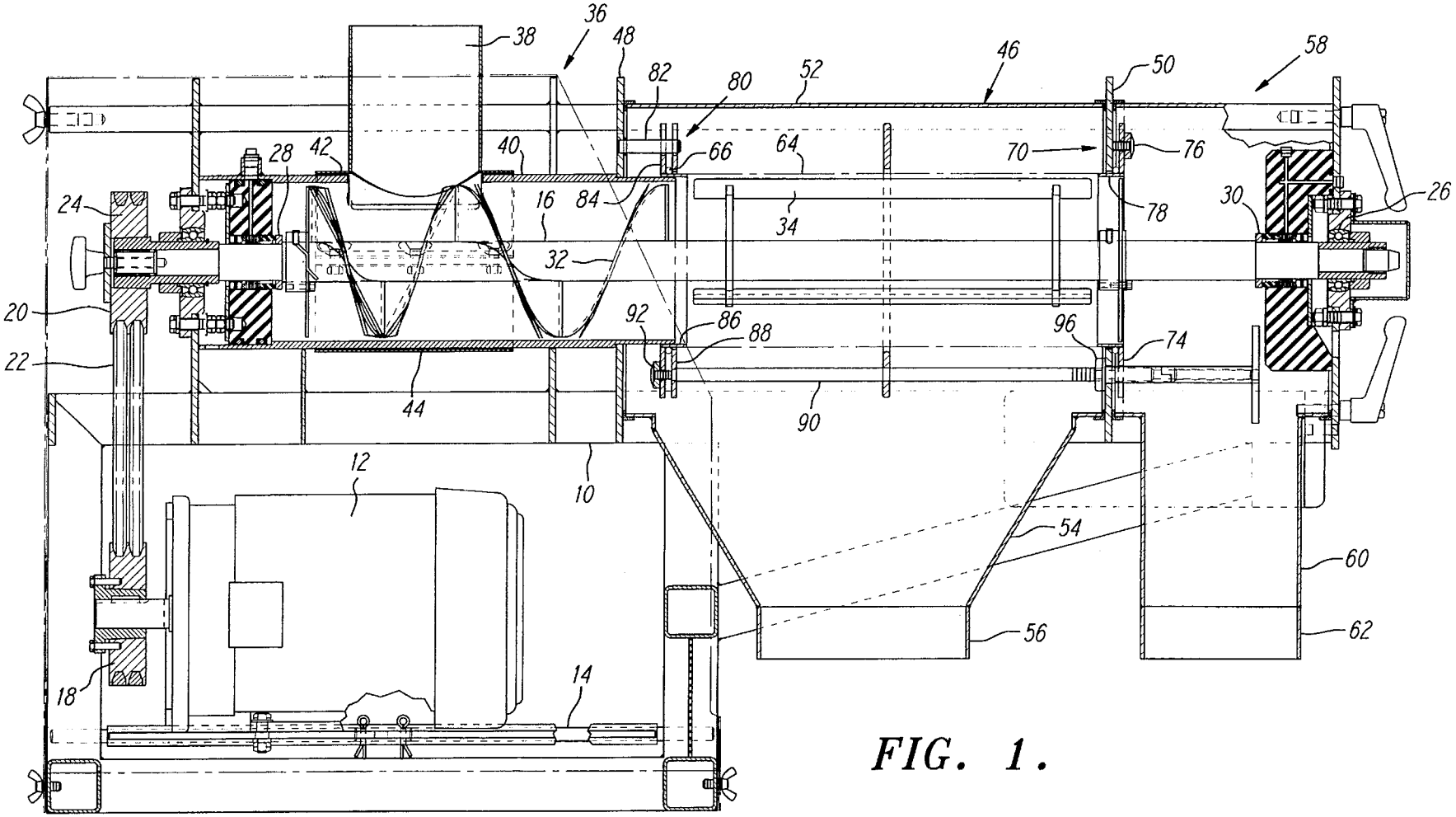
FIG. 1 is a cross-sectional elevation of a centrifugal sifter.
Figure 2:
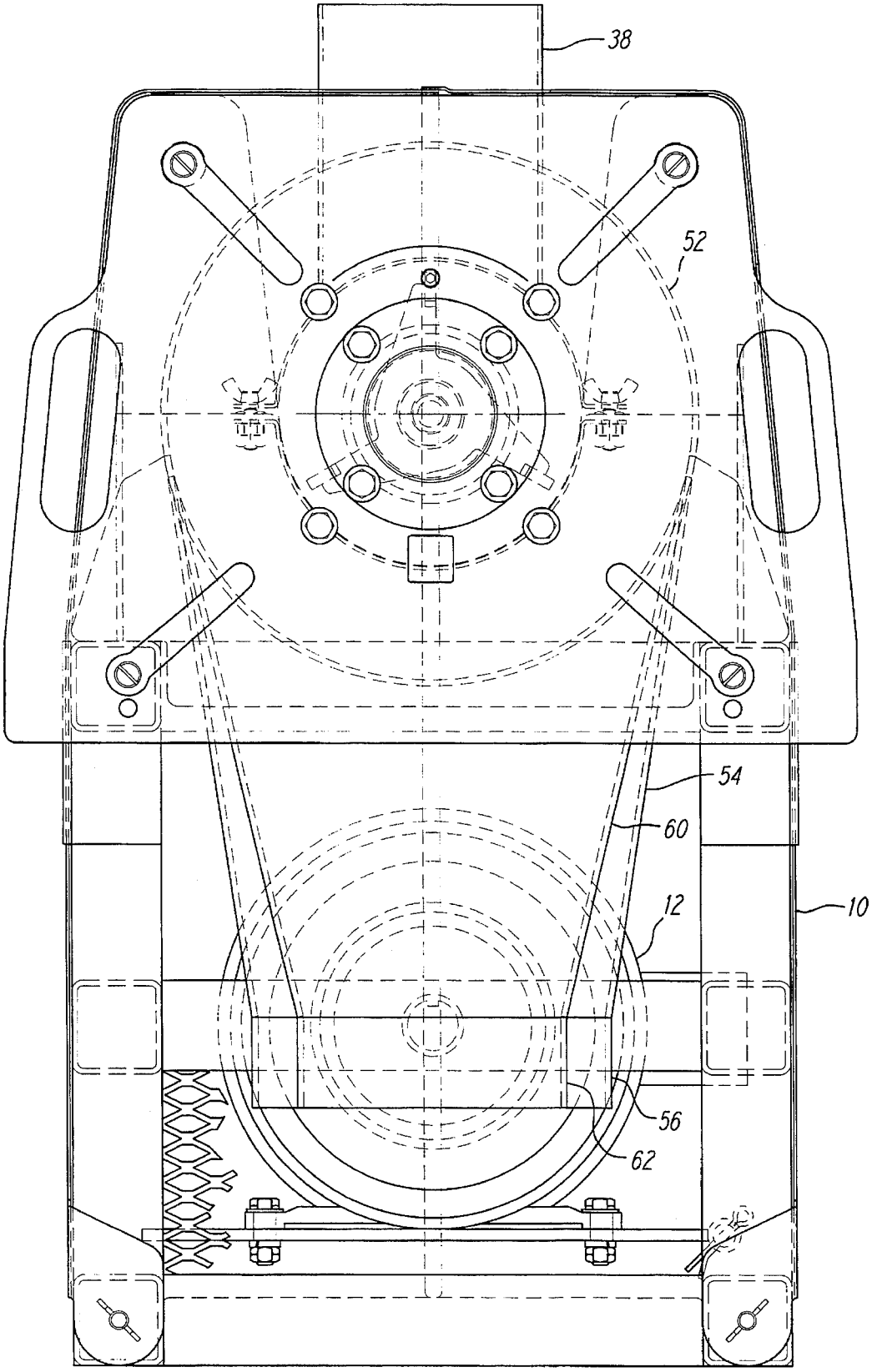
FIG. 2 is an end view of the centrifugal sifter of FIG. 1 looking from the right.
Figure 3:
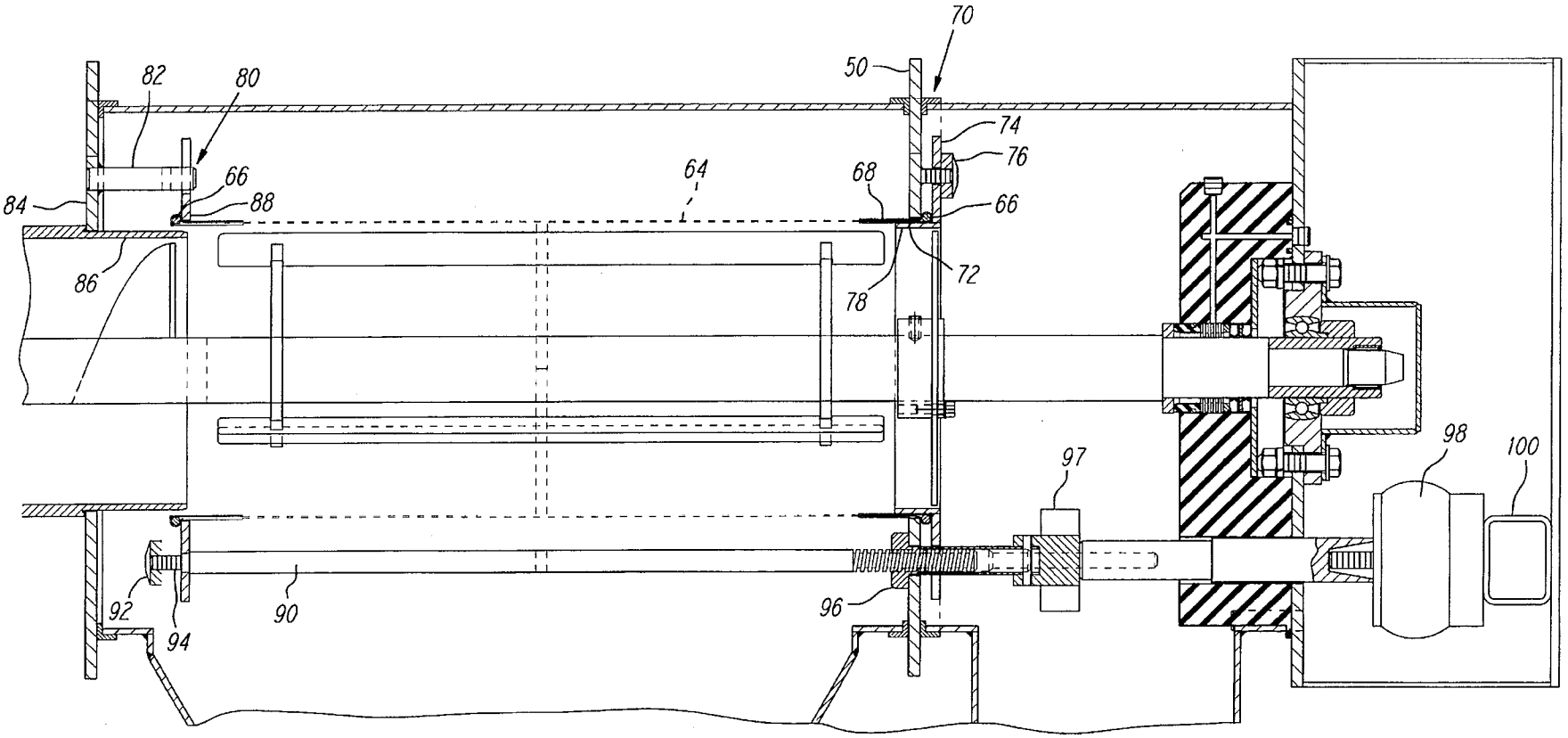
FIG. 3 is a cross-sectional side view of the screen clamp and resilient tensioning assembly of the centrifugal sifter of FIG. 1.
Figure 4:
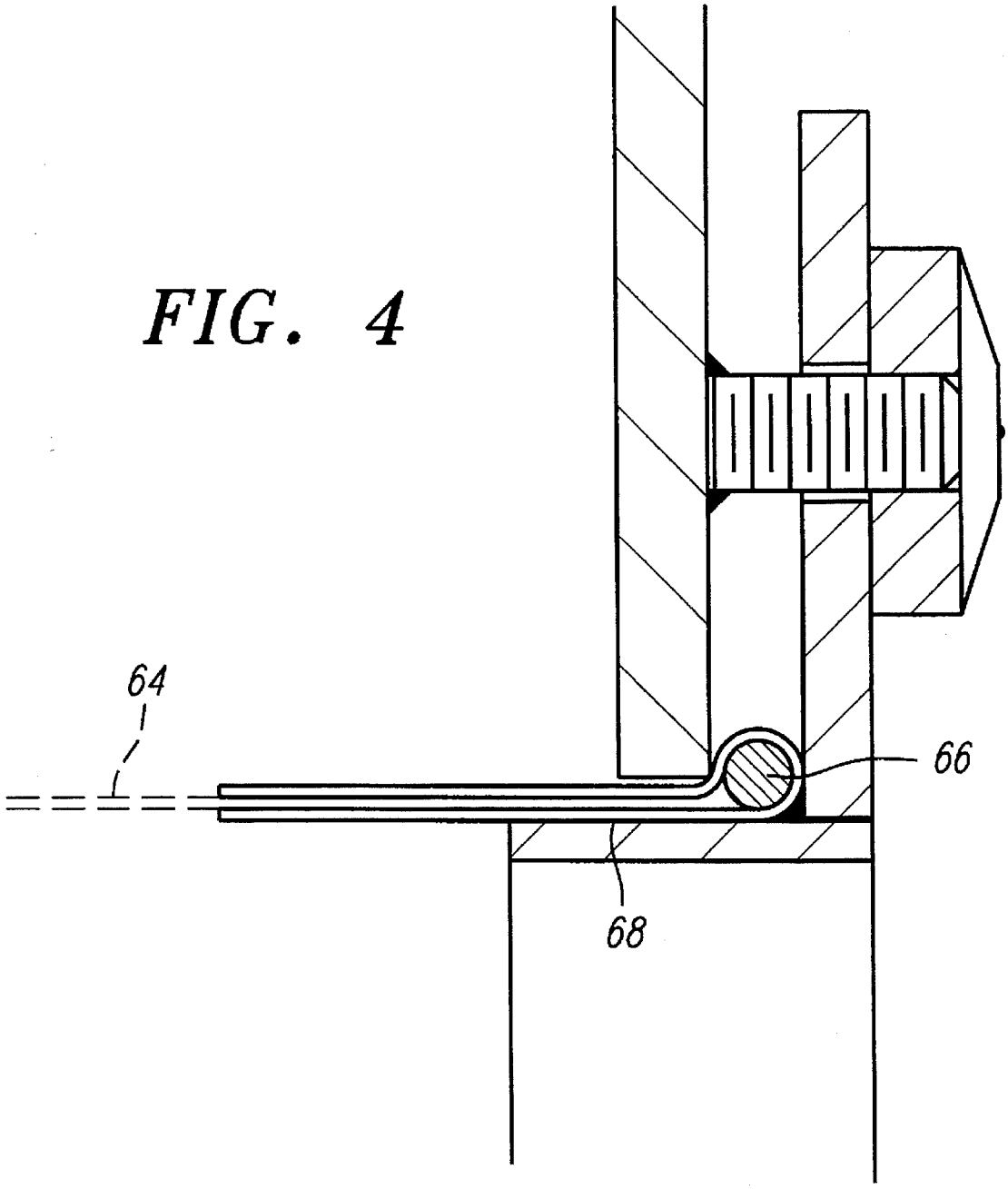
FIG. 4 is a cross-sectional detail view of one end of a cylindrical screen of the centrifugal sifter of FIG. 1.

Turning in detail to the drawings, a centrifugal sifter is illustrated as including a frame 10. Mounted to the frame 10 is a motor 12. The motor is pivotally mounted about a rod 14. Above the motor 1.2, a shaft 16 is rotatably arranged in the frame 10. Pulleys 18 and 20 on the motor 12 and shaft 16, respectively, are connected by belts 22. The pivotal mounting of the motor 12 allows tension to be placed on the belts 22 to assure proper transfer of power.

The shaft 16 is rotatably mounted in bearings 24 and 26. Thrust bearings 28 and 30 also locate the shaft 16. An auger 32 is arranged on a first portion of the shaft 16. Three paddles 34 are equiangularly disposed adjacent the auger 32 on a second portion of the shaft 16.

An inlet manifold 36 includes a vertical pipe 38 directly above the auger 32. A cylindrical housing 40 extends around the shaft 16 and the auger 32 from the bearings 24 and 28 to the end of the auger 32 adjacent to the paddles 34. The cylindrical housing 40 has a hole therethrough to accommodate the vertical pipe 38. The vertical pipe 38 is associated with a first semicylindrical element 42 which is drawn around the cylindrical housing 40 using a bolt and wing nut arrangement with a second semicylindrical element 44 to form a clamp.

An outlet manifold 46 is arranged about the paddles The outlet manifold 46 includes end plates 48 and 50 with a cylindrical housing 52 therebetween. The end plate 48 has a hole centrally located therein to receive the cylindrical housing 40 about the auger 32. The end plate 50 also has a central hole therethrough for material which does not pass through the screen. The cylindrical housing 52 about the paddles 34 includes an outlet 54 from the bottom thereof. The outlet 54 extends to a nozzle 56 for coupling with subsequent conveying, containing or processing equipment.

A second outlet manifold 58 is defined to the other side of the end plate 50 by the same housing 52. An outlet 60 extends to a nozzle 62 for discharge.

Arranged about the paddles 34 within the cylindrical housing 52 and between the end plates 48 and 50 is a cylindrical screen 64! . The cylindrical screen 64 may be formed from a flat sheet, rolled into a cylinder or tube by laying the edges one on top of the other and seaming the formed tube by various methods. The seaming can be accomplished by sewing, a head seal or, in the case of woven metal screens, soldering or fusion welding. The open ends are often seamed similarly. Sewn tape or head seal tape may be used at the ends depending on the mesh and fiber diameter. Such end treatment prevents fraying of the screen and makes the ends more rigid. Some end seam tapes are folded over both the inside and outside to embed the ends of the screen within the folded tape. A cord or wire may be inserted within the folded tape to further increase the rigidity of the screen tube ends. With woven metal screens, head seal tape is often applied to both end seams to embed the wire mesh to prevent fraying, to prevent injury from the otherwise exposed wire ends and also to prevent the screen from slipping out of position. Screens such as described have been used for some period of time in conventional centrifugal sifters. In the preferred embodiment, a circular bead 66 is positioned and retained at each end of the cylindrical screen 64. Where the screen is metal, the bead 66 may be soldered or welded in place. In this instance, the circular bead 66 may be square in cross section so as to better attach to the screen. Otherwise, folded tape 68 may be employed to retain the bead 66. In this instance, the bead 66 would normally be circular in cross section. The cylindrical screen 64 thus formed has a diameter which provides for some space outwardly of the paddles 34. There is not intended to be any mechanical scraping action of the paddles on the screen.

To mount the screen 64, a first screen clamp 70 is arranged in association with the end plate 50. The end plate 50 includes a central hole 72 of sufficient diameter to receive the cylindrical screen 64. However, the hole 72 has a diameter which is less than that of the circular bead 66 at either end of the cylindrical screen 64. By deforming the bead, the cylindrical screen 64 can be arranged such that it extends through the hole 72 in the end plate 50 which will define a locking plate for retaining the screen in this position. The end plate 50 is rigidly associated with the frame 10.

A mounting plate 74 is fixed to the end plate 50 by means of four studs 76. The mounting plate 74 also includes a central opening. A short cylinder 78 extends from the mounting plate 74 about the central opening. With the mounting plate 74 secured to the end plate 50, the short cylinder 78 extends through the hole 72 in the end plate 50. With the cylindrical screen 64 in place, the short cylinder 78 extends inwardly of that screen 64 and the circular bead 66. In this way, the circular bead is trapped between the end plate 50 and the mounting plate 74 so as to be securely retained.

At the other end of the outlet manifold 46 from the end wall 50, a second screen clamp 80 is slidably mounted relative to the frame 10. Parallel guides 82 extend parallel to the shaft 16 and parallel to the central axis of the screen from the end wall 48. A mounting plate 84 includes slots arranged to receive the parallel guides 82. The mounting plate includes a short cylinder 86 arranged in a central hole within the mounting plate 84. The short cylinder 86 extends over the end of the circular housing 40. A locking plate 88 is positioned next to the mounting plate 84. The locking plate 88 also has a central hole therethrough to fit over the short cylinder 86. In the same manner as the screen clamp 70, the screen 64 may be positioned with the circular bead 66 at the end thereof between the mounting plate 84 and the locking plate 88.

To appropriately operate the centrifugal sifter, the cylindrical screen 64 is preferably tensioned axially. A resilient tensioning assembly operates on the screen clamp 80 to bias the screen clamp 80 away from the screen clamp 70, resulting in a tension cylindrical screen 64. The assembly includes rods 90 which slidably extend through the end wall 50 and are threadably engaged with nuts 92 by defining threaded studs 94 at their ends. There are four such rods in the preferred embodiment equiangularly spaced about and outwardly of the screen 64. A shoulder on each rod 90 abuts against the locking plate 88. A nut 96 is threaded to each rod 90. The nuts 96 abut against the end wall 50 and are adjusted to keep the screen clamp 80 in position. Some tension in the screen 64 is advisable so that even if the pneumatic tensioning discussed below should fail, the screen 64 may remain spaced from the paddles 34. An adjusting knob 97 facilitates the proper adjustment.

A pneumatic expansion element is arranged at the end of each rod 90. In the preferred embodiment, air bags 98 are arranged against the ends of the rods 90. The other side of each air bag 98 is fixed axially relative to the frame 10 by abutting against a spacer 100. Tubes lead from the air bags 98 to a common pressure valve and vent such that the air bags may be inflated or deflated selectively. Air cylinders may also be used as well as a relatively constant force spring arrangement to create a resilient bias on the rods 90 and in turn on the screen clamp 80 to tension the cylindrical screen 64. The resilient nature of the tensioning mechanism provides for adjustment as the cylindrical screen 64 elongates during operation. In this way, the screen is unlikely to encounter the rapidly moving paddles 34 which otherwise results in high screen wear and/or catastrophic failure.

In operation, the sifter is assembled and pressure is applied to the air bags 98. With the air bags pressurized, the cylindrical screen 64is tensioned such that it is properly shaped and displaced from the paddles 34. The motor 12 may then be energized which causes the shaft 16 and in turn the auger 32 and paddles 313 to rotate rapidly. Material to be sifted may then be introduced through the vertical pipe 38 of the inlet manifold 36. The auger 32 conveys this material toward the paddles 34. The paddles 34 create movement of the material to be screened and pressure oscillations across the cylindrical screen 64. The material sifted through the screen 64 is then collected by the outlet manifold 46 and directed to the nozzle 56 for removal and transport. Material unable to pass through the cylindrical screen 64 ultimately moves from the end of the manifold 46 to the outlet manifold 58 where it is conveyed away through the nozzle 62.

Thus, an improved cylindrical sifter is described. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A centrifugal sifter comprising a frame;

a cylindrical screen having a circular bead at each end;

a first screen clamp fixed to the frame and including a first mounting plate having a first hole therethrough and a first cylinder extending about the first hole, the cylindrical screen extending closely over the first cylinder, and a first locking plate having a second hole therethrough and being fixed to the first mounting plate with the second hole extending over the cylindrical screen and the first cylinder, one of the circular beads being between the first mounting plate and the first locking plate and of greater diameter than the second hole;

a second screen clamp slidably mounted to the frame and including a second mounting plate having a third hole therethrough and a second cylinder extending about the third hole, the cylindrical screen extending closely over the second cylinder, and a second locking plate having a fourth hole therethrough and being fixed to the second mounting plate with the fourth hole extending over the cylindrical screen and the second cylinder, the other of the circular beads being between the second mounting plate and the second locking plate and of greater diameter than the fourth hole.

2. The centrifugal sifter of claim 1 further comprising a resilient tensioning assembly fixed at one end relative to the frame and at the other end relative to the second mounting plate.

3. The centrifugal sifter of claim 2, the tensioning assembly being in compression with the cylindrical screen in tension along its axis.

4. The centrifugal sifter of claim 2, the tensioning assembly including rods and pneumatic expansion elements arranged in series selectively to expand and contract the length of the assembly.

5. A screen clamp for a cylindrical screen of a centrifugal sifter, comprising a circular bead attached at one end of the cylindrical screen;

a mounting plate having a cylinder extending laterally from one side of the mounting plate, the cylindrical screen extending closely over the cylinder;

a locking plate having a hole therethrough and being fixed to the mounting plate with the hole extending over the cylindrical screen and the cylinder, the circular bead being between the mounting plate and the locking plate and of greater diameter than the hole.

6. The screen clamp of claim 5, the cylinder being hollow and the mounting plate including an access hole therethrough aligned with the hollow cylinder.

7. A centrifugal sifter comprising a frame including parallel guides;

a cylindrical screen;

a first screen clamp fixed to the frame and retaining one end of the cylindrical screen;

a second screen clamp slidably mounted to the frame on the parallel guides and retaining the other end of the cylindrical screen;

a resilient tensioning assembly fixed axially at one end relative to the frame and at the other end relative to the second screen clamp, the tensioning assembly including rods and pneumatic expansion elements arranged at one end of the rods, respectively, selectively to expand and contract the length of the tensioning assembly.

8. The centrifugal sifter of claim 7, the tensioning assembly being in compression with the cylindrical screen in tension along its axis.

* * * * *